US006530565B1

(12) United States Patent
Simpson

(10) Patent No.: US 6,530,565 B1
(45) Date of Patent: Mar. 11, 2003

(54) BAR CLAMP EXTENSION

(76) Inventor: Loran R. Simpson, 57800 270th St., Ames, IA (US) 50010

( * ) Notice: Subject to any disclaimer, the term of this patent is extended or adjusted under 35 U.S.C. 154(b) by 0 days.

(21) Appl. No.: 09/847,733

(22) Filed: May 2, 2001

(51) Int. Cl.[7] ..... B25B 1/00

(52) U.S. Cl. ..... 269/6; 269/3; 269/147; 269/148; 269/170

(58) Field of Search ..... 269/3, 6, 170, 269/166–169, 147–148, 271, 96; 52/749.1, 127.2, 127.5, DIG. 1; 248/274.1, 229.24, 245, 231.61; 403/292, 294, 286

(56) References Cited

U.S. PATENT DOCUMENTS

| | | | | | |
|---|---|---|---|---|---|
| 1,484,794 | A | | 2/1924 | Moses | |
| 1,583,611 | A | | 5/1926 | Seely | |
| 4,649,679 | A | * | 3/1987 | Arens | 52/181 |
| 4,735,389 | A | * | 4/1988 | Graham | 248/176 |
| 4,926,722 | A | | 5/1990 | Sorensen et al. | |
| 5,149,149 | A | * | 9/1992 | Wu | 403/292 |
| 6,029,964 | A | | 2/2000 | Bohl | |
| 6,089,556 | A | | 7/2000 | Whiteford | |
| 6,302,386 | B1 | * | 10/2001 | Fuller et al. | 269/6 |
| 6,386,530 | B1 | * | 5/2002 | Marks | 269/6 |

* cited by examiner

*Primary Examiner*—Lee Wilson
(74) *Attorney, Agent, or Firm*—Daniel A. Rosenberg; Kent A. Herink; Davis Brown Law Firm

(57) ABSTRACT

The present invention relates to an accessory for use with bar clamps, and more specifically, to a bar clamp attachment for extending a bar clamp to a plurality of working lengths. The bar clamp extension of the present invention generally comprises an extension bar and a coupler that releasably attaches the extension bar to a primary bar of a bar clamp.

8 Claims, 2 Drawing Sheets

BAR CLAMP EXTENSION

BACKGROUND OF THE INVENTION

1. Field of Invention

The present invention relates to an accessory for use with bar clamps, and more specifically, to a bar clamp attachment for extending a bar clamp to a plurality of working lengths.

2. Background of the Prior Art

Bar clamps are well known to craftsmen for use in holding a work piece in a fixed position. Typically, a bar clamp is used to hold a workpiece comprising multiple objects together for gluing, welding, or other purposes where it is advantageous to temporarily retain the workpiece in a fixed position. When encountering a clamping task, a craftsman will assess the size of a workpiece and select a clamp suitable for its retention. In cases calling for a bar clamp application, a craftsman selects a clamp having an appropriate length to embrace the subject work piece. However, to accomplish a variety of clamping tasks in association with a variety of projects, a craftsman is required to have multiple clamps of varying lengths.

One example of a prior art bar clamp is disclosed in U.S. Pat. No. 4,926,722 issued to Sorensen et al. The Sorensen et al. bar clamp comprises a movable jaw, a bar, and a fixed jaw. A disadvantage of the clamps known in the art, such as the Sorensen et al. bar clamp, is the finite length of the clamping bar. For example, while a movable jaw provides a variety of clamping positions along the length of the clamping bar, the finite length of the clamping bar limits the range of clamping positions available for each clamp. The finite length of each bar clamp requires a craftsman to purchase multiple clamps of varying lengths to accommodate various workpieces in association with accomplishing a variety of clamping tasks.

Therefore, a longstanding need remains for improvements in bar clamping devices. Such improvements would provide a craftsman the capability of utilizing a movable jaw component and a fixed jaw component in conjunction with a variety of bar lengths to achieve a modifiable bar clamp of varying lengths.

SUMMARY OF THE INVENTION

An improved bar clamp extension attachment for extending the working length of a bar of a bar clamp to a plurality of working lengths is described comprising an extension bar that has transverse dimensions matching those of the bar of the bar clamp. The bar clamp extension of the present invention will extend the working length of a typical bar clamp that has a moveable jaw and a fixed jaw in slidable and fixed engagement, respectively, with the bar of the bar clamp. A plurality of projections or pins extend transversely from a first and second end of the extension bar. The pins engage a coupler at the first end for releasably joining the extension bar to the bar of the bar clamp at the end which held the fixed jaw, and engage the fixed jaw at the second end. In operation, the fixed jaw is removed from the bar of the bar clamp and attached to the second end of the extension bar. The first and second ends of the extension bar are interchangeable.

A coupler includes a receiving member that is generally U-shaped in transverse cross-section wherein the web section and leg sections are sized to closely accommodate the end portions of the bar of the bar clamp and the extension bar. The end portions of the bar and extension bar are placed in the receiving member with their pins aligned with corresponding recesses in the receiving member. The coupler or clamp also includes a cover plate with recesses that is placed over the bar and extension bar end portions with the recesses aligned with the pins at the end portions of the bar and extension bar. A central throughbore in the receiving member and cover plate receives a nut and bolt combination for securing the coupler to the end portions of the bar and extension bar. The extension bars pins are comprised of metal, or alternatively, are spring pins, roll pins, or dowels.

After the extension bar is connected to the bar clamp, the extended clamp functions in the same manner as the bar clamp prior to its modification. In operation, a workpiece is clamped between a movable jaw and a fixed jaw. Sqeezing a handle on the clamp advances the movable jaw along the bar until a desired pressure is applied to the workpiece. To open the clamp, a trigger is squeezed and the movable jaw is pulled and released from the workpiece.

These and other aspects of the present invention will become apparent to those skilled in the art upon reference to the following specification, drawings, and claims.

DETAILED DESCRIPTION OF THE INVENTION

Figure 2:
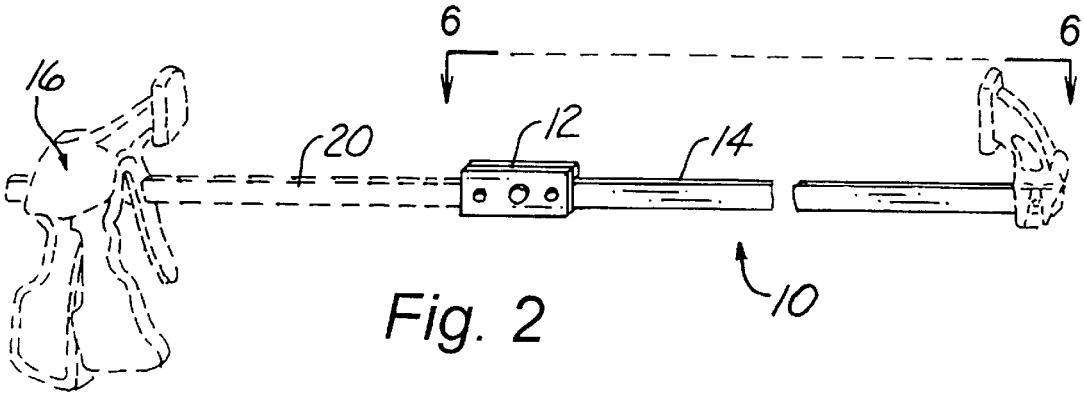
FIG. 2 is a perspective view of a bar clamp extension attachment in accordance with the teachings of the present invention with the prior art clamp of FIG. 1 shown in phantom.

As shown in the drawings, and referring in particular to FIG. 2, numeral 10 designates the bar clamp extension assembly of the present invention. The assembly 10 generally comprises a coupler 12 that releasably attaches an extension bar 14 to a primary bar 20 of a pistol-grip bar clamp 16 (shown in phantom).

Figure 1:
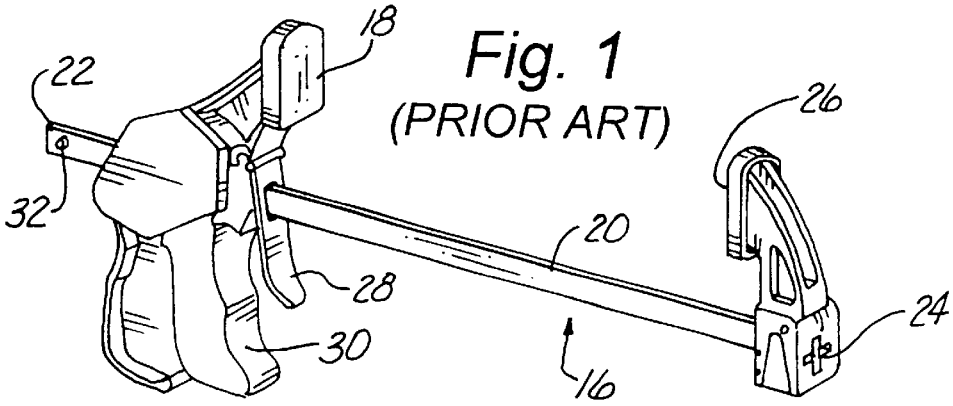
Fig. 1 (PRIOR ART)
FIG. 1 is a perspective view of a prior art clamp comprising a movable jaw, a bar, and a fixed jaw.

Referring now to FIG. 1, the pistol-grip bar clamp 16 includes a movable jaw 18 that is adjustable to a plurality of positions along primary bar 20. A proximal end 22 and a distal end 24 define primary bar 20. Typically, clamp 16 is configured with a fixed jaw 26 in secure engagement with the distal end 24 of primary bar 20. Bar 20 includes a proximal pin 32 and a distal pin 34 (FIG. 3), both of which extend transversely from bar 20. Distal pin 34 releasably engages fixed jaw 26. Sqeezing handle 30 advances jaw 18 along bar 20. In operation, a workpiece (not shown) is clamped between jaws 18, 26, by advancing movable jaw 18 along bar 20 toward fixed jaw 26 until a desired pressure is applied to the workpiece. To open the clamp, trigger 28 is squeezed in the direction of proximal end 22 and jaw 18 is pulled in the direction of proximal end 22.

Figure 3:
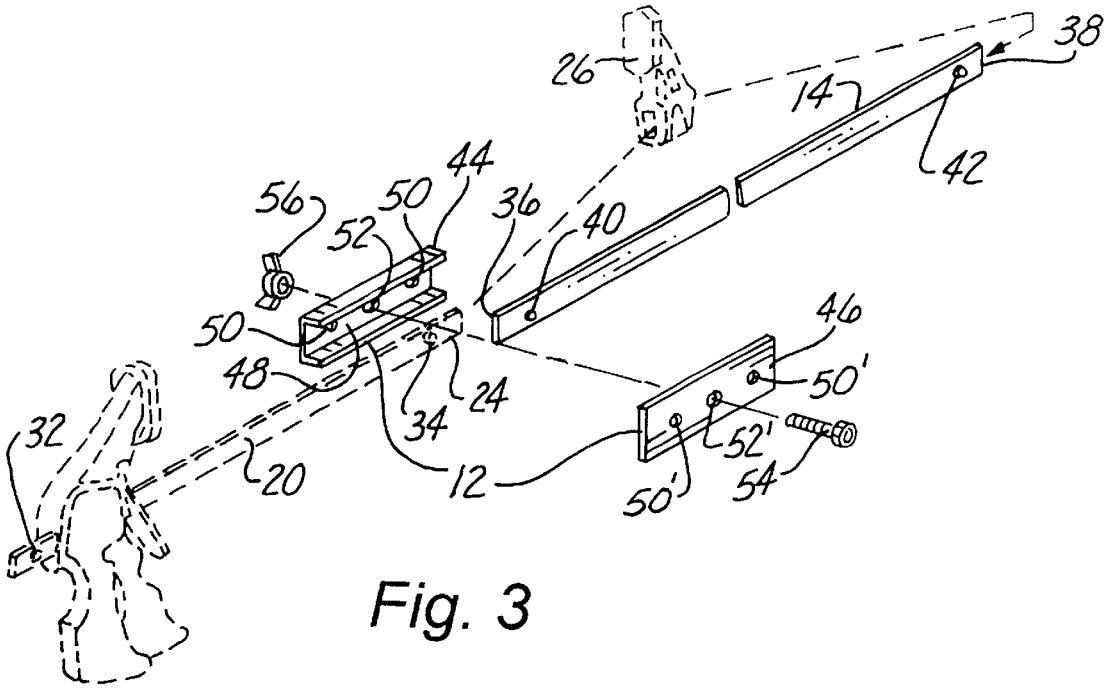
FIG. 3 is an exploded perspective view of the bar clamp extension attachment of FIG. 2 with the prior art clamp of FIG. 1 shown in phantom.
Figure 4:
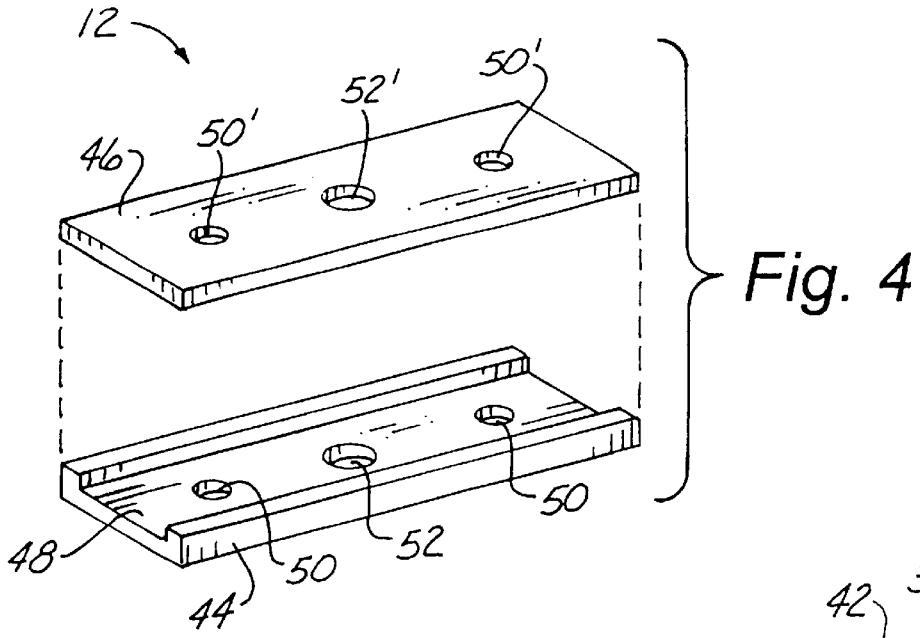
FIG. 4 is an enlarged perspective view of the cover plate and receiving member of the coupler.
Figure 5:
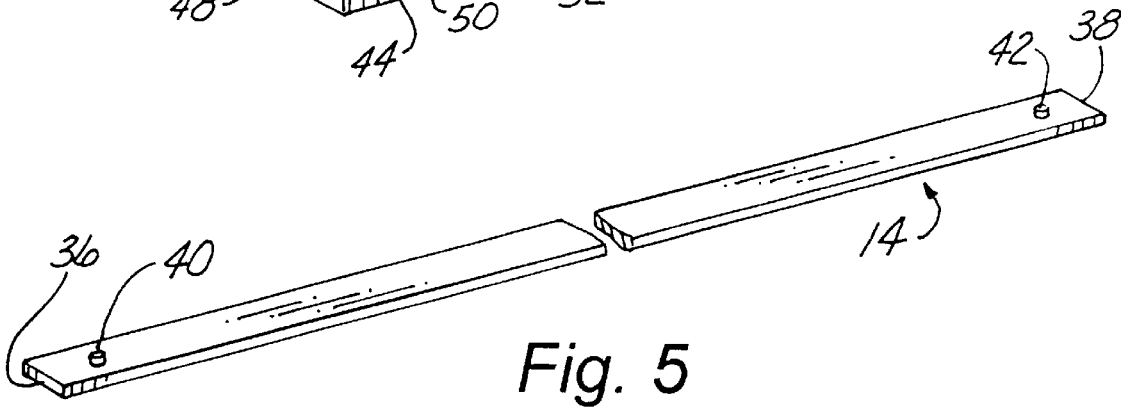
FIG. 5 is an enlarged perspective view of the extension bar.
Figure 6:
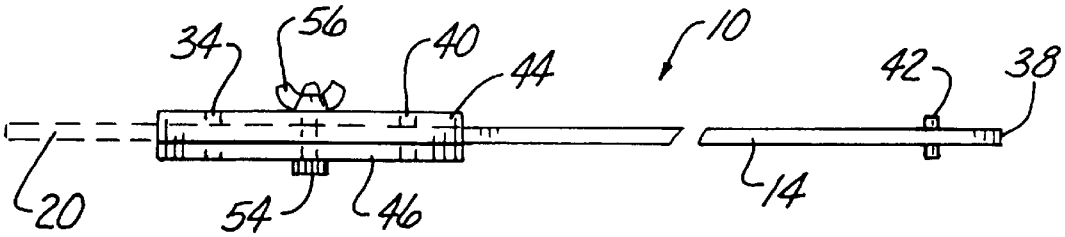
FIG. 6 is an enlarged top plan view of the extension bar and coupler.

As shown in FIG. 3, a proximal end 36 and a distal end 38 define extension bar 14. Bar 14 further includes proximal pin 40 and distal pin 42 extending transversely from bar 14.

To attach extension bar 14 to clamp 16, fixed jaw 26 is released from pin 34 and jaw 26 is slideably removed from end 24 of primary bar 20 and reattached to distal end 38 of extension bar 14. Jaw 26 releasably engages pin 42 to retain its fixed position at the distal end of bar 14. Also shown in FIG. 3, coupler 12 comprises a cover plate 46 and a receiving plate 44 having a cavity 48. Plates 44, 46 each include a plurality of pin recesses 50, 50' and a central bore 52, 52'. Pin recesses 50, 50' are provided for receiving pins 34 and 40. To attach the extension bar 14 to the clamp 16, the distal end 24 of primary bar 20 is aligned within the cavity 48 and receptively engaged by plate 44 and pin 34 is thereby receptively engaged by recesses 50. The depth of cavity 48 is consistent with the width of bar 20 such that cavity 48 snugly receives bar 20. Pin recesses 50 of plate 44 receives pin 34 and fixes the position of plate 44 relative to bar 20. Likewise, cavity 48 snuggly receives the proximal end 36 of extension bar 14 and recesses 50 receive pin 40. Pin recesses 50 of plate 44 receives pin 40 and fixes the position of plate 44 relative to bar 14. The cover plate 46 and its recesses 50' and bore 52' are aligned with receiving plate 44 and pins 34, 40, such that central bores 52, 52' are aligned for receiving a bolt 54 for securely engaging the sandwiched arrangement of plates 44, 46 about the junction of bars 20 and 14. Bolt 54 is received by central bore 52, 52' and is threadably engaged by nut 56 to secure the placement of plates 44, 46 in releasable engagement with bars 20, 14.

To accomplish the desired clamping effect, a user would have a series of extension bars 14 of varying lengths at his disposal. A modified pistol-grip bar clamp incorporating the bar clamp extension 10 easily accommodates a large workpiece by selecting an extension bar 14 having a length suitable for clamping the subject workpiece. A small workpiece is accommodated in much the same manner. The bar clamp extension 10 provides a user with a variety of clamping solutions without the need for individual clamps of varying lengths. Rather, a user merely selects an extension bar of a length suitable to accommodate a workpiece and modifies the pistol-grip bar clamp accordingly.

In a preferred embodiment, coupler 12 is non-orientation dependent, meaning it works equally as well in connecting bars 14 and 20 when the position of the plates 44, 46 relative to the bars 14, 20 is rotated by 180° about an axis formed by the bolt path 58 as shown in FIG. 3. Furthermore, the non-orientation dependent positions of receiving plate 44 and cover plate 46 can be reversed from the embodiment as shown in FIG. 3.

Also in a preferred embodiment, extension bar 14 is constructed of ¼ inch by ¾ inch surface hardened steel. Pins 40, 42 are ¼ inch in diameter and ⅝ inch in length. Furthermore, pins 40, 42 are spring pins, or alternatively, roll pins, or alternatively dowels pressed into bar 14. Plates 44, 46 are constructed of aluminum or steel and are machined to a configuration to receive and fit bar 14. Bolt 54 is preferably ¼ inch by 1 inch having 20 coarse thread per inch and is threadably received by plate 46. Nut 56 is ¼ inch in diameter having 20 coarse thread per inch. Alternatively, fasteners of other types well known in the art can be substituted for the nut/bolt fastener arrangement. For example, a hand knob having a female ¼ inch in diameter threaded receiving member, 20 coarse thread per inch, could be substituted for nut 56.

The foregoing description and drawings comprise illustrative embodiments of the present inventions. The foregoing embodiments and the methods described herein may vary based on the ability, experience, and preference of those skilled in the art. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

I claim:

1. A bar clamp extension apparatus for extending the working length of a bar clamp, the bar clamp including a primary bar and a fixed jaw that is releasably mounted on the distal end of the primary bar, wherein the fixed jaw is removed from the primary bar, the extension apparatus is attached to the distal end of the primary bar, and the fixed jaw is attached to the distal end of the extension apparatus, the extension apparatus comprising:

a. an extension bar having a proximal end section and a distal end section;

b. a pin projecting from either side of the distal end section of the extension bar for releasably attaching the fixed jaw of the bar clamp;

c. a pin projecting from either side of the proximal end section of the extension bar; and d. a coupler associated with the proximal end section of the extension bar for releasably attaching the proximal end section of the extension bar to the distal end of the primary bar in longitudinal alignment therewith; the coupler comprising:

i. a pair of plates positioned in contact engagement on either side of the proximal end of the extension bar and of the distal end of the longitudinally aligned primary bar;

ii. recesses in said plates for capturing the pin projecting from either side of the proximal end of the extension bar; and iii. means interconnecting the pair of plates for applying clamping pressure to hold the pair of plates in contact engagement with the primary bar and the extension bar.

2. Apparatus as defined in claim 1, wherein the means for interconnecting the pair of plates comprises a central bore through the pair of plates in receptive engagement with a fastener assembly.

3. Apparatus as defined in claim 2, wherein the fastener is a nut and bolt arrangement.

4. Apparatus as defined in claim 3, wherein the nut comprises a hand knob.

5. Apparatus as defined in claim 1, wherein the extension bar is reversible.

6. A bar clamp and bar clamp extension combination for extending the working length of the bar clamp, the combination comprising:

a primary bar with a distal end section and a proximate end section, with a pin projecting from either side of the distal end of the primary bar;

a moveable jaw movably attached to the proximate end section of the primary bar, having a squeezable handle for moving the jaw along the primary bar;

a fixed jaw;

an extension bar having a proximal end section and a distal end section;

a pin projecting from either side of the distal end section of the extension bar for releasably attaching the fixed jaw;

a pin projecting from either side of the proximal end section of the extension bar; and a coupler associated with the proximal end section of the extension bar and the distal end of the primary bar for releasably attaching the extension bar to the primary bar in longitudinal alignment therewith; the coupler comprising:

a pair of plates positioned in contact engagement on either side of the proximal end of the extension bar and of the distal end of the longitudinally aligned primary bar;

recesses in said plates for capturing the pin projecting from either side of the proximal end of the extension bar and the pin projecting from either side of the distal end of the primary bar; and means interconnecting the pair of plates for applying clamping pressure to hold the pair of plates in contact engagement with the primary bar and the extension bar.

7. Apparatus as defined in claim 6, wherein the interconnecting means for applying clamping pressure comprises a central bore through the pair of plates in receptive engagement with a nut and bolt arrangement.

8. Apparatus as defined in claim 7, wherein the nut comprises a hand knob.

* * * * *